US009180502B2

(12) United States Patent
Cernuschi et al.

(10) Patent No.: US 9,180,502 B2
(45) Date of Patent: Nov. 10, 2015

(54) ROLLING MILL STAND AND RELATED ROLLING MILL FOR LONGITUDINALLY ROLLING ROD-SHAPED BODIES

(71) Applicant: Danieli & C. Officine Meccaniche S.P.A., Buttrio (IT)

(72) Inventors: Ettore Cernuschi, Bareggio (IT); Fabrizio Marini, Cinisello Balsamo (IT); Aristide Giacomo Bertelli, Bresso (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 216 days.

(21) Appl. No.: 13/713,620

(22) Filed: Dec. 13, 2012

(65) Prior Publication Data

US 2013/0133392 A1 May 30, 2013

Related U.S. Application Data

(62) Division of application No. 12/736,872, filed as application No. PCT/EP2009/056201 on May 21, 2009, now Pat. No. 8,341,994.

(30) Foreign Application Priority Data

May 22, 2008 (IT) ..... MI2008A00947

(51) Int. Cl.

| | |
|---|---|
| ***B21B 13/12*** | (2006.01) |
| ***B21B 13/10*** | (2006.01) |
| ***B21B 17/04*** | (2006.01) |

(Continued)

(52) U.S. Cl.

CPC ..... *B21B 13/12* (2013.01); *B21B 13/103* (2013.01); *B21B 17/04* (2013.01); *B21B 31/10* (2013.01); *B21B 13/04* (2013.01); *B21B 17/14* (2013.01); *B21B 31/103* (2013.01); *B21B 2203/06* (2013.01); *Y10T 29/49815* (2015.01)

(58) Field of Classification Search

CPC ..... B21B 31/10; B21B 31/103; B21B 13/12; B21B 17/14; B21B 31/02; B21B 2203/06; B21B 2203/32

USPC ..... 72/224, 225, 234, 235, 237, 238, 239, 72/249

See application file for complete search history.

(56) References Cited

U.S. PATENT DOCUMENTS

| | | | |
|---|---|---|---|
| 3,152,494 | A | 10/1964 | Petereit et al. |
| 3,221,529 | A | 12/1965 | Chang |

(Continued)

FOREIGN PATENT DOCUMENTS

| | | |
|---|---|---|
| DE | 2839687 | 3/1908 |
| DE | 2845052 | 4/1980 |

(Continued)

*Primary Examiner* — Edward Tolan

(74) *Attorney, Agent, or Firm* — Stetina Brunda Garred & Brucker

(57) ABSTRACT

A rolling mill stand and related rolling mill for rolling rod-shaped bodies, even large in size, which meets the requirement of stiffness uniformity of the rolling mill stands in the transversal direction, all the hydraulic capsules being firmly fixed to the external structure of the rolling mill and providing for the side change of the rolls of each stand. The arrangement of rolling rolls and related extensions of each rolling mill stand is such to avoid problems of corrosion and damaging to the extensions themselves and to the reducers due to the drainage of the cooling waters.

20 Claims, 5 Drawing Sheets

(51) Int. Cl.

| | |
|---|---|
| ***B21B 31/10*** | (2006.01) |
| *B21B 13/04* | (2006.01) |
| *B21B 17/14* | (2006.01) |

(56) References Cited

U.S. PATENT DOCUMENTS

| | | | | |
|---|---|---|---|---|
| 4,194,381 | A | 3/1980 | Jockel | |
| 4,212,180 | A | 7/1980 | Cattaneo et al. | |
| 5,765,423 | A * | 6/1998 | Cattaneo et al. | 72/224 |
| 6,116,071 | A | 9/2000 | Cernuschi et al. | |
| 8,640,516 | B2 * | 2/2014 | Cernuschi et al. | 72/235 |
| 8,677,794 | B2 * | 3/2014 | Cernuschi et al. | 72/235 |
| 2003/0217579 | A1 | 11/2003 | Bindernagel et al. | |
| 2012/0103048 | A1 * | 5/2012 | Vieten et al. | 72/226 |

FOREIGN PATENT DOCUMENTS

| | | | | |
|---|---|---|---|---|
| DE | 3237904 | A1 * | 4/1984 | B21B 31/10 |
| DE | 10015285 | | 10/2001 | |
| DE | 102005042835 | | 5/2007 | |
| EP | 0719600 | | 7/1996 | |
| JP | 5-317937 | A * | 12/1993 | B21B 35/00 |
| JP | 7-9010 | A * | 1/1995 | B21B 13/10 |
| WO | 9400254 | | 1/1994 | |
| WO | 2007014911 | | 2/2007 | |

* cited by examiner

ROLLING MILL STAND AND RELATED ROLLING MILL FOR LONGITUDINALLY ROLLING ROD-SHAPED BODIES

CROSS REFERENCE TO RELATED APPLICATIONS

This application is a divisional of U.S. application Ser. No. 12/736,872, filed Nov. 18, 2010, which claims priority to International Application No. PCT/EP2009/056201, filed May 21, 2009, which claims priority to Italian Application No. MI2008A00947, filed May 22, 2008.

FIELD OF THE INVENTION

The present invention relates to a rolling mill stand with three adjustable rolls and to a rolling mill comprising a plurality of said rolling mill stands for longitudinally rolling rod-shaped bodies, such as tubes or cylindrical bodies such as bars, rods, etc.

STATE OF THE ART

Multi-stand rolling mills having motorized rolls have been used for several years for longitudinally rolling rod-shaped bodies, specifically tubes, in which each stand is provided with three rolls and the position of said rolls may be advantageously adjusted by changing the distance between the roll itself and the rolling axis, in order to be able to obtain different thicknesses on a same internal tool or mandrel. An example of this type of rolling mills is described in U.S. Pat. No. 5,331,835, wherein the roll replacement is carried out through a movement along the axis of the rolling mill, thus exploiting the space existing between the rolling mill itself and the next rolling mill of the extractor type, adapted to remove the rolled tube from the mandrel. This solution, which includes the axial roll change, is satisfactory until the size of the parts to be extracted from the rolling mill do not exceed the available space between the rolling mill itself and the next rolling mill of the extractor type; this occurs in systems for producing tubes up to 14"-16" with a restricted number of stands, five for example, the number of stands being determined according to the desired deformation and the predetermined yearly yield. Indeed, when the rolled body, due to the normal system restrictions, is shorter than the distance between the last stand of the rolling mill and the first stand of the extractor-type rolling mill, the extraction of the tube from the mandrel is difficult and the possibility of malfunctions and process interruptions, due to jamming, considerably increases. Alternative solutions have been suggested for system producing tubes larger in size, e.g. 16"¾-18", because all the sizes become difficult to be achieved in practice and the stiffness of the structure is further decreased by the annular structure becoming increasingly wider, to allow the roll-holder cartridge to pass through, and therefore the external transversal dimensions must be gradually increased, causing increasing difficulties in practically manufacturing the product, i.e. mechanical processing difficulties.

U.S. Pat. Nos. 6,041,635 and 6,116,071 disclose solutions with roll side change systems, but however do not meet the needs of stiffness uniformity of the stands in the transversal direction, because they still include a hydraulic stand capsule of the tilting type, mounted to a hinged arm, and in any case not firmly connected to the external structure. This solution further requires the use of non-stiff tubing for connecting the movable hydraulic capsule.

Furthermore, the arrangement of the rolls of each stand includes an extension for the stand arranged at 30° with respect to the vertical. This arrangement causes technical problems due to the presence of cooling water drainage along the extensions themselves with troubles of corrosion and damaging to the extensions themselves. The reducer below is also exposed to water.

The need to make a rolling mill stand and a related rolling mill capable of overcoming the aforesaid drawbacks is thus felt.

SUMMARY OF THE INVENTION

It is an object of the present invention to provide a rolling mill for rolling rod-shaped bodies, even large in size, which meets the requirement of stiffness uniformity of the rolling mill stands in the transversal direction, all the hydraulic capsules being firmly fixed to the external structure of the rolling mill stands and providing for the side change of the rolls of each stand.

It is a further object to provide a rolling mill stand with all the hydraulic capsules firmly fixed thereto, having an arrangement of rolling rolls and related extensions such as to provide for the side extraction of the roll-holder cartridge on a horizontal plane and avoid the aforesaid problems of corrosion and damaging to the extensions themselves and to the reducers.

The present invention thus intends to reach the above-discussed objects by making a rolling mill stand, defining a rolling axis, comprising: a fixed external structure; three working rolls arranged in a roll-holder cartridge, said cartridge being movable from a working position inside the fixed structure, at said rolling axis, to a side extraction position outside the fixed structure for changing the working rolls; wherein at least one respective hydraulic capsule firmly fixed to the fixed structure is provided for each working roll; wherein at least one first hydraulic capsule is of the double stroke type, including in addition to a first working stroke for adjusting the radial position of the respective working roll, a second clearance stroke from the roll axis, to facilitate the side extraction of said roll-holder cartridge; and wherein a second hydraulic capsule is horizontally arranged to allow the side extraction of said roll-holder cartridge along a horizontal plane, in accordance with claim 1.

It is a further object of the present invention a rolling mill for rolling rod-shaped bodies, defining a rolling axis, comprising a plurality of rolling mill stands, said rolling mill stands being arranged in sequence and tilted by a 180° angle with respect to the previous one, to the vertical axis passing through the rolling axis, wherein the roll-holder cartridges are alternatively extracted from the various stands of the rolling mill from the two sides of the mill itself, in accordance with claim 10.

It is a further object of the invention a process of extracting a roll-holder cartridge from a working position, inside a rolling mill stand, to a side position outside said stand for changing the working rolls, the process comprising the following steps:

- disengaging the working roll-extension joints for the first extension and for the second extension arranged on the side where the second hydraulic capsule horizontally arranged is provided;
- actuating the extension-holding device for supporting the second extension, arranged on the extraction side of the roll-holder cartridge;

actuating the slide so as to release the further second extension from the respective working roll and sliding the slide from an all forward position to an all backward position;

lowering the extension-holding device so as to take said second extension to a position not interfering with the horizontal plane for the extraction of the roll-holder cartridge;

extracting the roll-holder cartridge from said working position to said external side position along said horizontal plane, in accordance with claim 13.

The dependent claims describe preferred embodiments of the invention.

The rolling mill, object of the present invention, advantageously includes, for each rolling mill stand having three rolls, a hydraulic simple-stroke capsule, i.e. with working stroke only, horizontally arranged, and two hydraulic double-stroke capsules, a working stroke and a clearance stroke from the rolling axis to allow the roll change, said double-stroke capsules being inclined with respect to the vertical axis of the stand and including an opening of the piston such as to allow the extraction of the roll-holder cartridge in the horizontal direction from the side opposite to the horizontally arranged hydraulic capsule.

Without departing from the scope of the present invention, two hydraulic capsules may be mounted for each roll, as obtained in tube rolling mills of the previous generation having two rolls for each stand.

This type of solution advantageously allows the side extraction of the roll-holder cartridge without altering the dynamic functionality of the system for adjusting the radial position of the rolling rolls, which is important for ensuring the thickness tolerances on the tube head. Unlike the solutions of the prior art, the capsules are all with limited working stroke, mounted so as to be fixed to the external structure of the rolling mill.

Furthermore, appropriate devices are provided for carrying the roll controlling extensions clear from the positions occupied by the cartridge during its extraction from the rolling mill, once the roll controlling extensions themselves have been released.

In the solution according to the invention, the rolling mill consists of a plurality of stands arranged in sequence and tilted by 180° with respect to the previous one to the vertical axis passing through the rolling axis, therefore the roll-holder cartridges are alternatively extracted from the rolling mill on the two sides of the rolling mill itself, again with an exclusively horizontal movement which facilitates the operations for replacing the cartridges because there are no weights arranged on inclined planes to be compensated during the change operations, as in some of the known solutions which provide for the side change of the rolls.

A further advantage is represented by the side change of the roll-holder cartridge allowing the external structure to be fixed with plates interposed between the cartridges, these plates being considerably stiffer than those of the rolling mills characterized by the axial cartridge change.

Furthermore, in the case of side roll change, the fixed annular structure has an internal diameter of several meters, e.g. 2-3 m, while on the other hand, with the side change, the central hole of each plate is only used to pass the rolling tube through, and thus is typically smaller than 1 meter. This implies a considerable stiffening of the structure with advantages for the whole rolling process:

It is indeed known the practice of compensating for the elastic give of the structure by approaching the working rolls to the rolling axis, such an approach being substantially inversely proportional to the stiffness of the structure and directly proportional to the force exerted on each working roll by the tube. Thus, by using the rolling mill according to the invention, the entity of such compensations to the advantage of product quality may be reduced.

BRIEF DESCRIPTION OF THE DRAWINGS

Further features and advantages of the present invention will be more apparent from the detailed description of a preferred, but not exclusive, embodiment of a rolling mill illustrated by the way of non-limitative example, with the aid of the accompanying drawings, in which.

DETAILED DESCRIPTION OF A PREFERRED EMBODIMENT OF THE INVENTION

Figure 1:
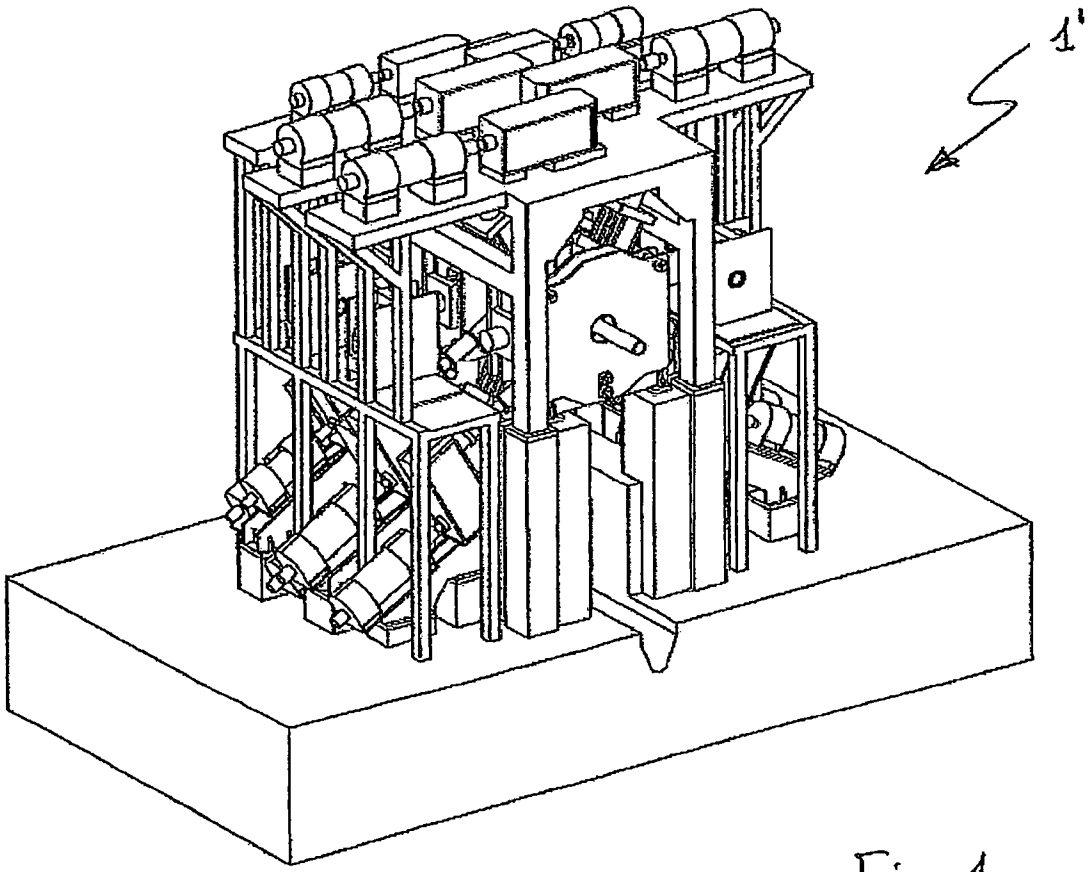
FIG. 1 shows a perspective view of the rolling mill according to the invention.

Figures from 1 to 3 show a rolling mill 1' according to the invention comprising, in this embodiment, five rolling mill stands 1 having three motorized rolls 2 arranged in a roll-holder cartridge 3.

The following are provided for each rolling or working roll 2 in each rolling mill stand 1:

a hydraulic capsule 4', 4" for adjusting the radial position of the roll 2 with respect to the rolling axis of the rolling mill;

a control extension 5, 5', 5", e.g. a tooth or cardan extension, for transmitting the motion to the roll;

a motor 6 and a reducer 7, provided upstream and connected to said control extension.

All hydraulic capsules advantageously have a limited working stroke and are firmly fixed to the external structure of the rolling mill.

The geometric configuration of the rolling mill stand according to the invention advantageously includes a vertical extension 5, arranged over the roll-holder cartridge 3, and two extensions 5', 5", inclined with respect to the vertical axis by a predetermined angle preferably equal to about 60°, so as to avoid the cooling water drainage from causing problems of corrosion and damaging to extensions and reducers.

Advantageously, in each rolling mill stand 1, one hydraulic capsule 4' is of the simple stroke type, i.e. has only one working stroke, and is horizontally arranged, while the other two hydraulic capsules 4" are of the double stroke type, i.e. have a working stroke for adjusting the radial position of the roll and a clearance stroke from the rolling axis to allow the rolls to be changed, i.e. the roll-holder cartridge 3 to be extracted.

It can be noted that the horizontal capsule of the double stroke type may be mounted without departing from the teaching of the invention, and without compromising the system operation.

The hydraulic capsules 4" are appropriately inclined with respect to the vertical axis, preferably by an angle of ±30° and configured so as to include an opening of the piston such as to allow the extraction of the roll-holder cartridge 3 in the horizontal direction from the side opposite to the horizontally arranged hydraulic capsule 4'.

Figure 6:
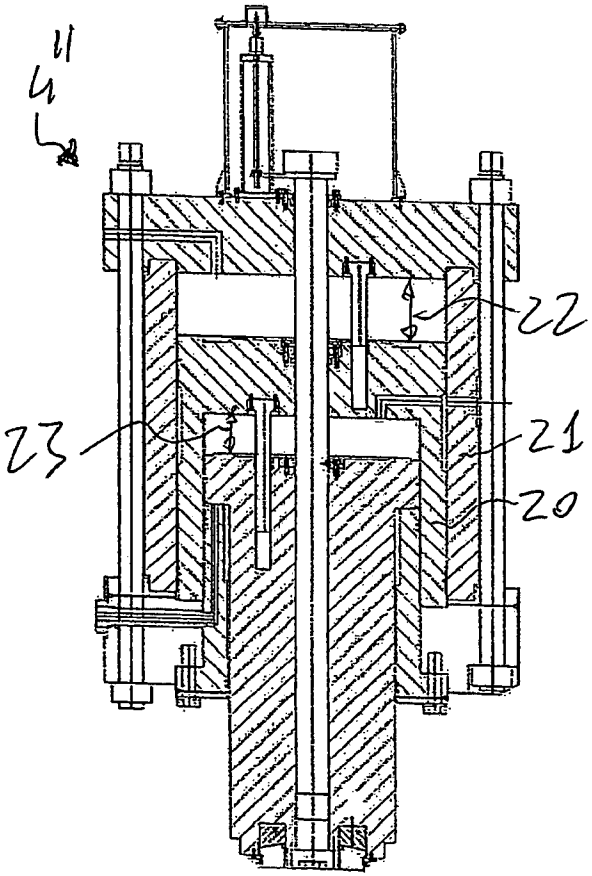
FIG. 6 shows a section view of the hydraulic capsule in all-open position.

The working stroke 23 of the hydraulic capsules 4" must be appropriately limited, as shown in FIG. 6, in order to be able to ensure a suitable promptness of the position control system of the capsule itself. For example, said working stroke 23 is equal to about 150 mm.

Furthermore, it is worth noting that under working conditions, the piston is in an intermediate position of the working stroke itself, its position being adjusted by means of position control systems which normally are of the servo-controlled type and common in the prior art.

The geometry of the system according to the invention requires a minimum stroke for the capsules 4" of about 400 mm, a value which is not compatible with the dynamic functionality of the system itself. Indeed, in the brief impact time of the tube head under the rolling mill stand, the oil pressure would rapidly raise from an expected value of about 30-40 bar to a peak value of about 240 bar. This pressure increase would imply a yielding of the position of the capsule piston, which must be compensated by introducing new oil into the main chamber. Such an amount is proportional to the piston stroke, while the time in which the adjustment occurs does not depend on the stroke of the capsule itself. In a rolling mill used for rolling single pieces of moderate length, e.g. 8-35 meters, it is important to overcome this type of problem in order to ensure the thickness tolerances on the tube head.

Therefore, the rolling mill of the invention advantageously includes the use of the inclined, hydraulic, double-stroke capsules 4".

Figure 5:
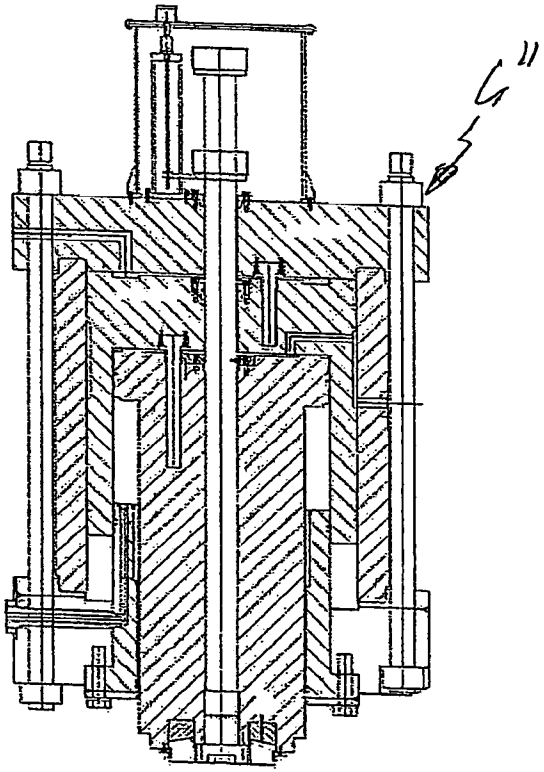
FIG. 5 shows a section view of a hydraulic capsule used in the rolling mill of the invention, in a closed position, i.e. contracted; this is the position taken by the capsule during the operations for extracting the roll-holder cartridge.

In a preferred embodiment, shown in FIGS. 5 and 6, the capsules 4" are of the open type and mainly comprise the following three components:

a movable piston 19 which acts on the seal-holder yoke, a hollow piston 20 in which the piston 19 slides, a fixed external cylinder 21.

Under working conditions (FIG. 6), the stroke 23 of piston 19 is limited, for example to about 150 mm, while under roll change conditions (FIG. 5), thus in the absence of rolling forces, the hollow piston 20 moves from the position shown in FIG. 6 to that shown in FIG. 5 by a stroke corresponding to the height of the chamber 22, about 250 mm, and therefore the total stroke of the piston 19 becomes equal to the sum of the two strokes, i.e. about 400 mm.

When rolling, the hollow piston 20 mechanically abuts with the pressurized chamber 22, as shown in FIG. 6, so as to ensure the abutment itself also when the piston 19 is stressed by the rolling force.

The double stroke capsules 4" may be made with different configurations from that shown in the figures without departing from the scope of the present invention.

Furthermore, the hydraulic movement of the stroke 22 of the hollow piston 20 could be replaced with other devices, e.g. of the mechanical type such as jacks or the like, however without departing from the scope of the present invention.

The device for balancing the assembly formed by roll and seal consists of a cylinder provided with an extensible, pivoting hammer head. This solution allows to directly apply the balancing force between the piston 19 and the seal-holder yoke, thus allowing the balancing system itself to disappear inside the piston of the hydraulic capsule.

The balancing system is coaxial to the axis of the piston 19 of the hydraulic capsule.

The hydraulic capsule 4' of each stand does not require any oversized stroke and therefore may be of the traditional type, without movable top device. Its stroke is therefore equal to the working stroke of the two inclined capsules 4" which, in this embodiment, is 150 mm. The balancing device of the horizontal hydraulic capsule 4' may be of the same type as that already described for the inclined capsules 4". This type of solution advantageously allows the roll-holder cartridge 3 to be extracted without altering the dynamic functionality of the system for adjusting the radial position of the working rolls.

In order to allow the roll-holder cartridge 3 to be laterally extracted in the vertical direction, after releasing the control extensions, the same extensions must be carried clear with respect to the positions occupied by the cartridge 3 during its extraction stroke from the rolling mill.

Figure 3:
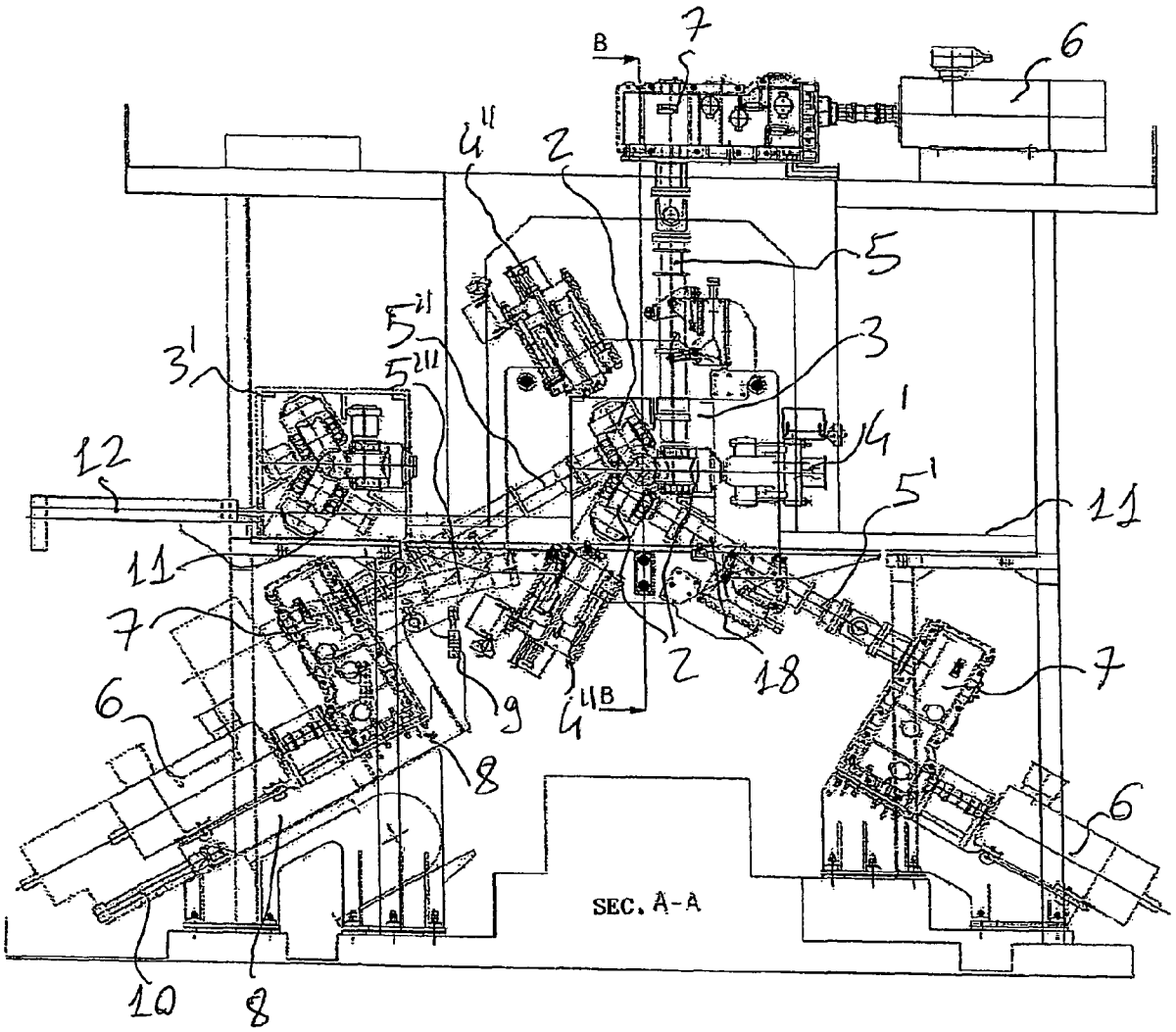
FIG. 3 shows a section view along plane A-A of the rolling mill in FIG. 1.

With reference to the section at a rolling mill stand shown in FIG. 3, the solution of this problem is conventional for the vertical extension 5 and inclined extension 5' provided on the side opposite to the extraction side of the cartridge itself. Indeed, the extensions are retractable and sprung per se; using a known device for releasing the extension to disengage the extension and make the horizontal extraction movement of the cartridge 3 possible is therefore sufficient.

A slide 8 is advantageously included, on which the whole assembly consisting of motor 6, reducer 7, extension-holding device 9 and extension 5" is mounted for the inclined extension 5", provided on the extraction side of the roll-holder cartridge 3, which is larger on the extraction path. The slide 8 is provided with appropriate blocking devices for its position, not shown in the figure because known per se in the art.

The slide 8 is appropriately inclined, preferably by about 30° with respect to the horizontal, and before proceeding with the extraction of the cartridge 3 from the rolling mill structure, the following steps are carried out:

actuating the extension-holding device 9 in the up position of the support of extension 5", releasing the slide 8 from the control position of extension 5", i.e. from the all forward position of the slide, and retracting the slide itself by means of a hydraulic cylinder 10, thus disengaging the roll-extension joint, to reach the all backward position, lowering the extension-holding device 9 in order to carry the extension 5" to the position 5'" (dashed position in FIG. 3) clear from the space which is gradually occupied by the cartridge 3 which is laterally extracted.

In the case of the extension 5", extension releasing devices are not required to be arranged because the release is directly carried out by the movement of the slide 8.

The three extensions 5, 5', 5" of each rolling mill stand are advantageously equivalent to one another, thus determining a maintenance advantage by limiting the number of type of spare parts.

The configuration of the rolling mill object of the present invention implies that the roll-holder cartridges 3 are extracted from the different stands of the rolling mill along a horizontal plane, alternatively on the two sides of the rolling mill itself. The rolling mill is advantageously provided with two side-shift systems, on one side for odd stands and on the other side for even stands. Each of these two systems essentially consists of a platform 11 moving along a direction which is parallel to the rolling axis, controlled by a hydraulic cylinder 15.

Figure 2:
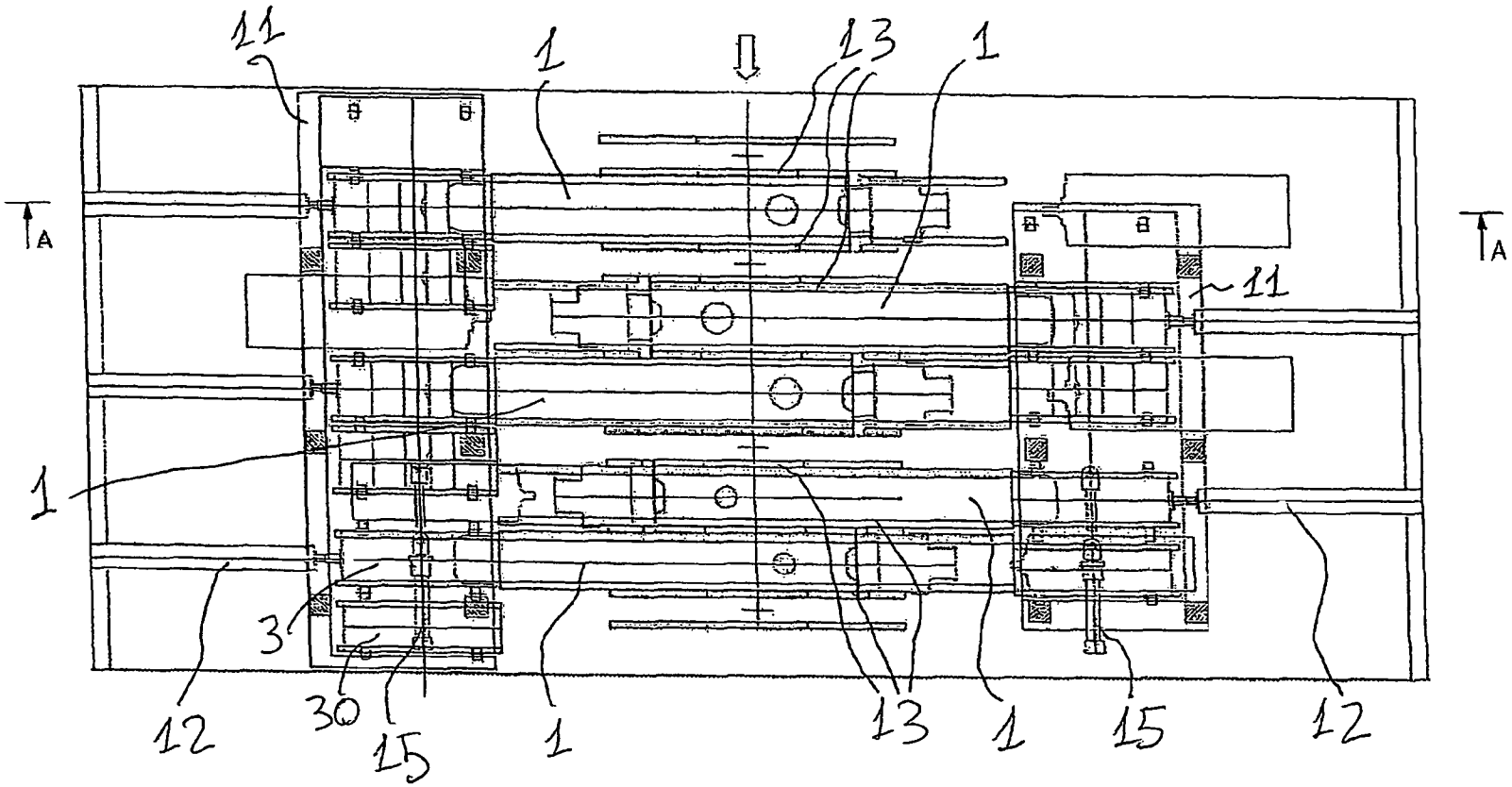
FIG. 2 shows a plan view of the rolling mill according to the invention.

Once the cartridge or cartridges which need to be replaced have been laterally extracted, i.e. once the cartridge has reached the extraction position 3' (FIG. 2), the platform 11 translates so as to show a new roll-holder cartridge 30 aligned with the axis of the corresponding stand and said new cartridge 30 is transversally inserted into the rolling mill, moving again on a horizontal plane by means of the hydraulic cylinder 12.

The change of the roll-holder cartridges on the two sides allows to not occupy system parts which are normally occupied by other machine parts or transfer systems. The two movable platforms 11 are indeed in plan view within the area occupied by the control groups of the rolling mill itself, thus allowing to contain the transversal dimensions of the rolling mill itself.

Furthermore, the side change of the roll-holder cartridges allows the fixed external structure to be achieved with plates 13 interposed between the cartridges, these plates 13 being considerably stiffer than those provided in rolling mills characterized by the axial cartridge change.

Figure 4:
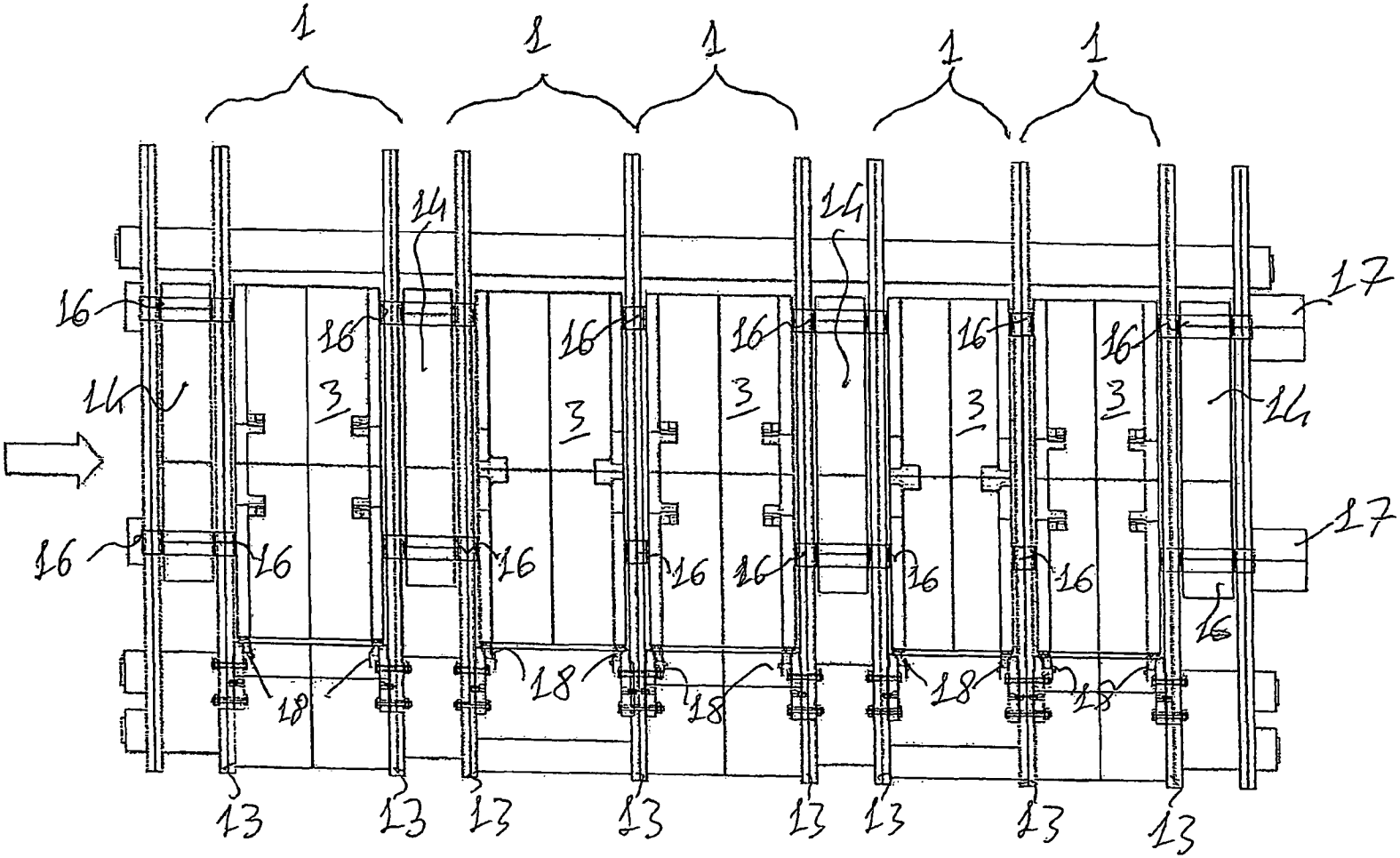
FIG. 4 shows a section view along plane B-B of the rolling mill in FIG. 1.

The roll-holder cartridges 3 may be blocked by means of an axial blocking of the reciprocally sandwiched cartridges, using movable spacers 16 (FIG. 4) fitted in the holes arranged for this purpose in the walls between the stand. The small mandrel-holding stands 14 will also be provided with movable spacers 16 in the axial direction, so as to allow the axial packing of the cartridges by means of conventional devices 17. The small mandrel-holding stands 14 are of known type and extractable for maintenance.

The axial blocking of the roll-holder cartridges allows to effectively oppose the dynamic forces acting along the rolling axis on the cartridges, which derive from the loading and unloading movements under each stand when the head and tail of the rolling body pass.

Each roll-holder cartridge will be aligned inside the structure in the traversal direction, both in the horizontal and vertical directions, horizontally pushing the cartridge against fixed stops by means of the hydraulic cylinders 12, used for transversally translating the cartridge in and out of the mill, and lifting it by means of further hydraulic cylinders 18 having a short stroke, lower than 60 mm for example.

The invention claimed is:

1. A rolling mill for rolling rod-shaped bodies, defining a rolling axis, comprising a plurality of rolling mill stands arranged in sequence and tilted by a 180° angle with respect to the previous one, to the vertical axis passing through the rolling axis, each rolling mill stand comprising a fixed external structure, three working rolls arranged in a roll-holder cartridge, said roll-holder cartridge being movable from a working position inside the fixed structure, at said rolling axis, to a side extraction position outside the fixed structure for changing the working rolls, wherein at least one respective hydraulic capsule is provided for each working roll, wherein, in each rolling mill stand, a first hydraulic capsule is horizontally arranged to allow said roll-holder cartridge to be extracted along a horizontal plane, wherein said at least one respective hydraulic capsule is firmly fixed to the fixed structure, for each working roll, and wherein the roll-holder cartridges of the rolling mill stands are configured to be alternatively extracted from the various stands of the rolling mill on the two sides of the rolling mill itself along said horizontal plane.

2. A rolling mill according to claim 1, wherein there are provided two side-shift systems, one side-shift system on each side of the rolling mill, each side-shift system comprising a platform moving along a direction parallel to the rolling axis.

3. A rolling mill according to claim 2, wherein each movable platform is controlled by a respective hydraulic cylinder.

4. A rolling mill stand according to claim 1, wherein there are provided two second hydraulic capsules inclined with respect to a vertical axis passing through the rolling axis by a predetermined first angle, and configured so as to allow the roll-holder cartridge to be extracted along said horizontal plane on the side opposite to the first hydraulic capsule, preferably said predetermined first angle being of about 30°.

5. A rolling mill stand according to claim 4, wherein for each working roll there is provided a respective control extension, a first extension of which is vertically arranged over the working position of the roll-holder cartridge, and two second extensions are arranged inclined with respect to the vertical axis by a second angle of about 60°.

6. A rolling mill stand according to claim 5, wherein for a second extension arranged on the extraction side of the roll-holder cartridge, there is provided a slide on which there are mounted an extension-holding device and the second extension itself.

7. A rolling mill stand according to claim 6, wherein said slide slides on a plane appropriately inclined with respect to the horizontal and is suitable for passing from a control position of the second extension to a retracted position so as to release said second extension from the respective working roll and take it to a position which does not interfere with the horizontal plane for extracting the roll-holder cartridge.

8. A rolling mill stand according to claim 4, wherein said second hydraulic capsules are of the movable top type and comprise a movable piston acting on the seal-holder yoke of the roll, a hollow piston in which the movable piston slides and a fixed external cylinder.

9. A rolling mill stand according to claim 8, wherein a device for balancing the roll-seal assembly comprises a cylinder provided with an extensible, pivoting hammer head.

10. A process for extracting a roll-holder cartridge from a working position, inside a rolling mill stand of a rolling mill according to claim 1, to a side position outside said rolling mill stand for changing the working rolls, the process comprising the following steps:

disengaging working roll-extension joints for a first extension and for a second extension arranged on a side where the first hydraulic capsule is horizontally arranged;

actuating an extension-holding device for supporting the second extension, arranged on the extraction side of the roll-holder cartridge;

actuating a slide so as to release the second further extension from the respective working roll and sliding the slide from an all forward position to an all backward position;

lowering the extension-holding device so as to take said second extension to a position which does not interfere with the horizontal plane for extracting the roll-holder cartridge;

extracting the roll-holder cartridge from said working position to said external side position along said horizontal plane.

11. A process for extracting a roll-holder cartridge from a working position, inside a rolling mill stand of a rolling mill according to claim 1, to a side position outside said rolling mill stand for changing the working rolls, the process comprising the following steps:

disengaging working roll-extension joints for a first extension and for a second extension arranged on a side where the horizontally arranged hydraulic capsule is provided;

actuating an extension-holding device for supporting the second extension, arranged on the extraction side of the roll-holder cartridge;

actuating a slide so as to release the second further extension from the respective working roll and sliding the slide from an all forward position to an all backward position;

lowering the extension-holding device so as to take said second extension to a position which does not interfere with the horizontal plane for extracting the roll-holder cartridge;

extracting the roll-holder cartridge from said working position to said external side position along said horizontal plane.

12. A rolling mill for rolling rod-shaped bodies, defining a rolling axis, comprising a plurality of rolling mill stands arranged in sequence and tilted by a 180° angle with respect to the previous one, to the vertical axis passing through the rolling axis, each rolling mill stand comprising a fixed external structure, three working rolls arranged in a roll-holder cartridge, said roll-holder cartridge being movable from a working position inside the fixed structure, at said rolling axis, to a side extraction position outside the fixed structure for changing the working rolls, one horizontally arranged hydraulic capsule and two hydraulic capsules inclined with respect to the vertical axis and configured so as to include an opening of a respective piston such as to allow an extraction of the roll-holder cartridge along a horizontal plane from the side opposite to the horizontally arranged hydraulic capsule, wherein all hydraulic capsules are firmly fixed to the fixed structure, and wherein the roll-holder cartridges of the rolling mill stands are configured to be alternatively extracted from the various stands of the rolling mill on the two sides of the rolling mill itself along said horizontal plane.

13. A rolling mill according to claim 12, wherein there are provided two side-shift systems, one side-shift system on each side of the rolling mill, each side-shift system comprising a platform moving along a direction parallel to the rolling axis.

14. A rolling mill according to claim 13, wherein each movable platform is controlled by a respective hydraulic cylinder.

15. A rolling mill stand according to claim 12, wherein the other two hydraulic capsules are inclined with respect to the vertical axis by a predetermined first angle, preferably of about 30°.

16. A rolling mill stand according to claim 15, wherein for each working roll there is provided a respective control extension, a first extension of which is vertically arranged over the working position of the roll-holder cartridge, and two second extensions are arranged inclined with respect to the vertical axis by a second angle of about 60°.

17. A rolling mill stand according to claim 16, wherein for a second extension arranged on the extraction side of the roll-holder cartridge, there is provided a slide on which there are mounted an extension-holding device and the second extension itself.

18. A rolling mill stand according to claim 17, wherein said slide slides on a plane appropriately inclined with respect to the horizontal and is suitable for passing from a control position of the second extension to a retracted position so as to release said second extension from the respective working roll and take it to a position which does not interfere with the horizontal plane for extracting the roll-holder cartridge.

19. A rolling mill stand according to claim 12, wherein the other two hydraulic capsules are of the movable top type and comprise a movable piston acting on the seal-holder yoke of the roll, a hollow piston in which the movable piston slides and a fixed external cylinder.

20. A rolling mill stand according to claim 19, wherein a device for balancing the roll-seal assembly comprises a cylinder provided with an extensible, pivoting hammer head.

* * * * *